United States Patent [19]

Williams

[11] 4,451,067

[45] May 29, 1984

[54] COMPREHENSIVE, CENTRAL SCHEDULING FOLDER FOR PROJECT MANAGEMENT

[76] Inventor: Marvin E. Williams, 1318 Brairmeadow Dr., Worthington, Ohio 43085

[21] Appl. No.: 383,501

[22] Filed: Jun. 1, 1982

[51] Int. Cl.[3] ..... B42D 3/18; B42D 17/00

[52] U.S. Cl. ..... 281/31; 40/124.2; 40/124.4; 150/35; 281/15 R; 281/45; 283/2

[58] Field of Search ..... 281/45, 15 R, 31; 40/124.2, 124.4, 359, 360; 150/35, 39; 283/2, 3, 4

[56] References Cited

U.S. PATENT DOCUMENTS

| | | | |
|---|---|---|---|
| 837,481 | 12/1906 | Leuthesser | 40/124.4 |
| 1,510,621 | 10/1924 | Jedel | 281/45 X |
| 2,828,975 | 4/1958 | Wright | 150/39 X |
| 2,909,202 | 10/1959 | Rock | 150/35 |
| 3,839,809 | 10/1974 | Casas et al. | 281/31 X |
| 3,946,781 | 3/1976 | Reis | 150/35 |
| 4,008,742 | 2/1977 | Lemler | 40/124.2 X |
| 4,085,534 | 4/1978 | Eckstein et al. | 40/124.2 |
| 4,296,946 | 10/1981 | Larre | 281/45 |
| 4,330,951 | 5/1982 | Hauer | 40/124.2 |

*Primary Examiner*—Paul A. Bell
*Attorney, Agent, or Firm*—Frank H. Foster

[57] ABSTRACT

A management scheduling folder having a plurality of panels bound together. Each panel has pockets to support a column of project cards in overlapping arrangement to expose a portion of each card. A special calendar is mounted beside each column of cards and formed with a plurality of linear calendars extending laterally of the card in substantial alignment with the exposed portions of cards. Each card therefore has its own linear calendar on which to note its scheduling in close association with the card as well as closely associated with the calendars for other project cards.

6 Claims, 7 Drawing Figures

COMPREHENSIVE, CENTRAL SCHEDULING FOLDER FOR PROJECT MANAGEMENT

TECHNICAL FIELD OF THE INVENTION

This invention relates generally to tools and aids for improving the productivity and effectiveness of managers and more particularly relates to a scheduling folder for use as a project control center to maintain executive responsibility over a variety of projects.

BACKGROUND OF THE INVENTION

Effective and productive management requires a continuous overview of a variety of projects. A manager must schedule the projects and maintain his knowledge of their current status and periodic goals.

Some managers rely on their memory which is subject to the normal human forgetfulness. Others attempt to include scheduling information on appointment schedules.

One difficulty with using appointment calendars for scheduling is that schedules are diluted and sometimes lost among the other notations on an appointment calendar. Such calendars are often relatively small and are incapable of illustrating a project schedule covering long periods of time.

Other prior art techniques include preparing and filing schedules in individual files or folders. A difficulty with that system is that such folders are often relatively inaccessible and even when accessible do not show the interrelationship of one project schedule to that of other projects.

An additional conventional system is the preparation of wall placards or flow charts showing the scheduling of projects. These, however, are not portable, are not intended to include detailed information and are difficult to change or revise.

As a result of these difficulties with the prior art systems, important deadlines may be missed resulting in lost sales or decreased customer goodwill. Other results include last minute rushes, costly overtime, decreases in executive efficiency and increases in executive tension and stress which also lowers overall executive efficiency.

It is therefore an object of the present invention to provide a convenient, effective and portable system and folder for use in the system for scheduling multiple projects and maintaining constant supervision over all of them.

Another object of the present invention is to provide a scheduling folder which permits a comprehensive overview of a plurality of projects by review of a single conveniently carried folder which can include both short term and long term projects.

Yet another object of the present invention is to provide a scheduling folder which additionally provides detailed status information and allows the easy addition of updating notes, ideas and instructions.

Another object of the invention is to provide a scheduling folder which has great flexibility so that projects may be shifted around, new ones merged easily into the system and old projects removed all without disruption of other project information in the scheduling folder.

BRIEF SUMMARY OF THE INVENTION

The invention is a management scheduling folder having a plurality of panels bound like a looseleaf notebook. Each panel has at least one surface which holds a plurality of projects cards in overlapping arrangement in a column to expose a portion of each card. A special calendar is mounted beside each column of cards and has a plurality of parallel lines extending laterally of the card substantially aligned with the exposed edges of each card. These form bands of spaces. The calendar also has a plurality of spaced lines parallel to the column of cards. Each column is labelled with a time/calendar designation such as the hours of the day or the days of a week, month or year. Thus, each card has its own linear calendar formed by a lateral row of spaces which is coordinated with the time/calendar interval as well as the card and upon which notes may be made for relating the project of a card to scheduling times. Each project or subpart of a project effectively has its own calendar which is physically associated with the card and with the calendars of other projects.

Figure 1:
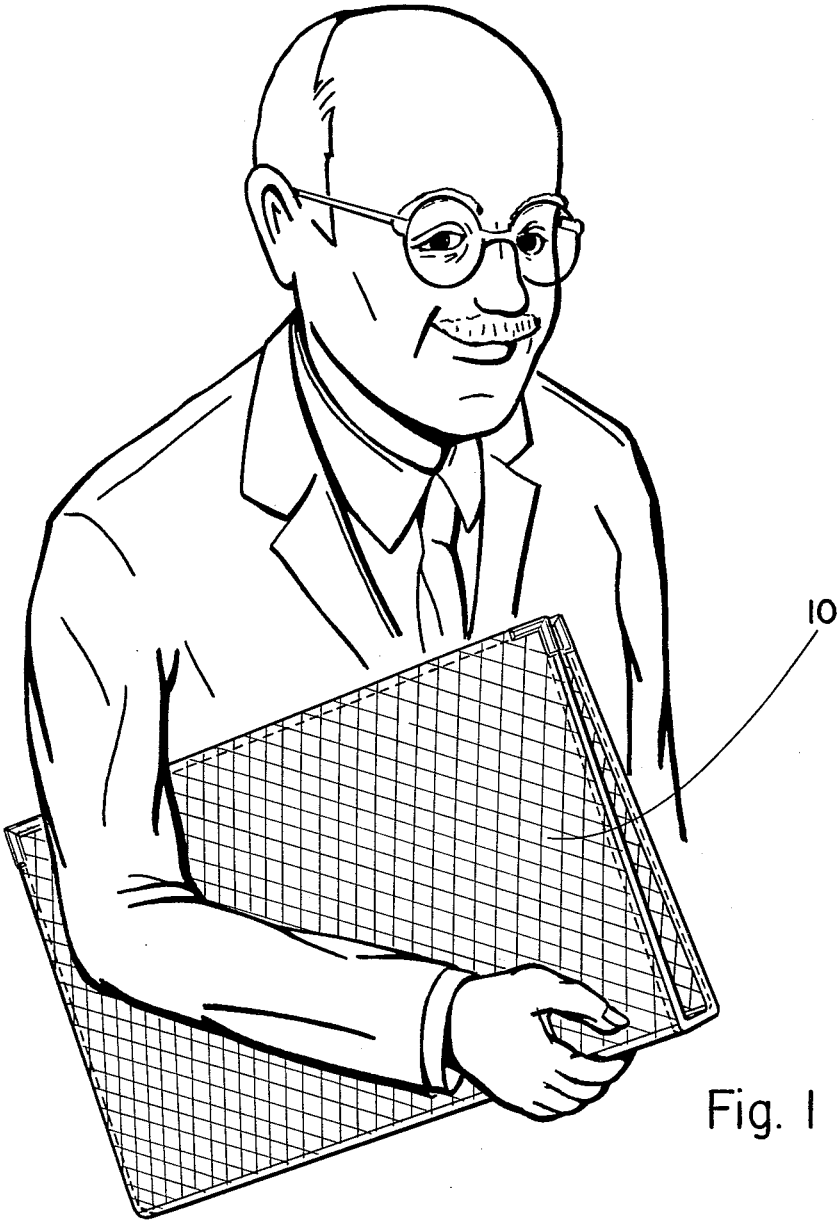
FIG. 1 is a view in perspective of an executive carrying a scheduling folder embodying the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION OF THE INVENTION

FIG. 1 illustrates a person carrying a management scheduling folder 10 embodying the present invention. The scheduling folder is relatively small so that it may be conveniently carried by the executive in much the same manner as a notebook or small briefcase. It may also be carried in a briefcase.

Figure 2:
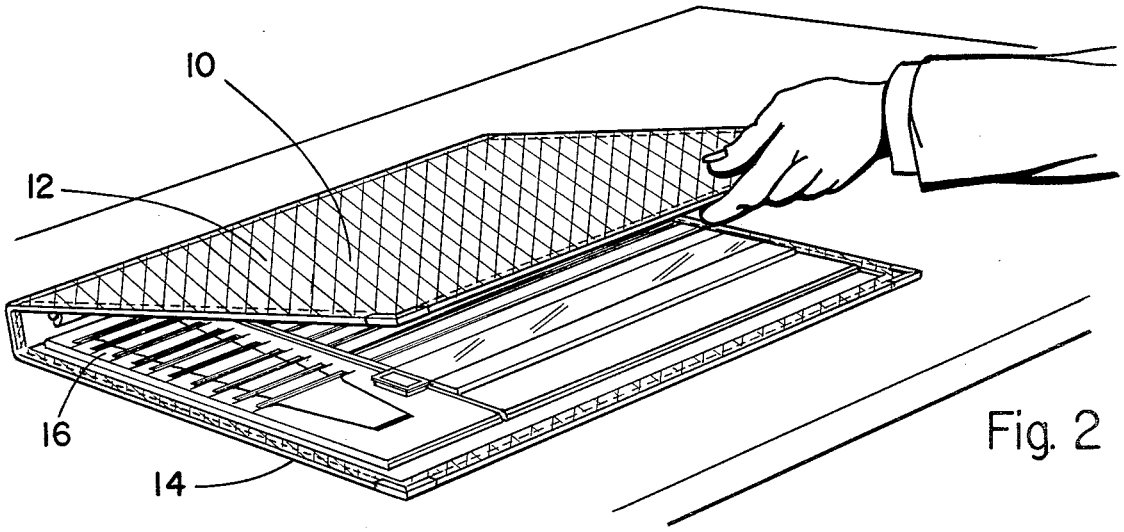
FIG. 2 is a view in perspective of the scheduling folder of FIG. 1 in the process of being opened into a working position.

Referring to FIG. 2, the scheduling folder 10 has a front panel 12 hingedly connected to a rear panel 14 and at least one intermediate panel 16 connected between the front panel 12 and the rear panel 14. Preferably the intermediate panel is held by separable rings in the manner of a looseleaf notebook. The scheduling folder may be conveniently set upon a desk or other work surface and opened as illustrated in FIG. 2 to the completely open position of FIG. 3 which exposes some of the information contained in the folder to provide an overview of projects.

Figure 3:
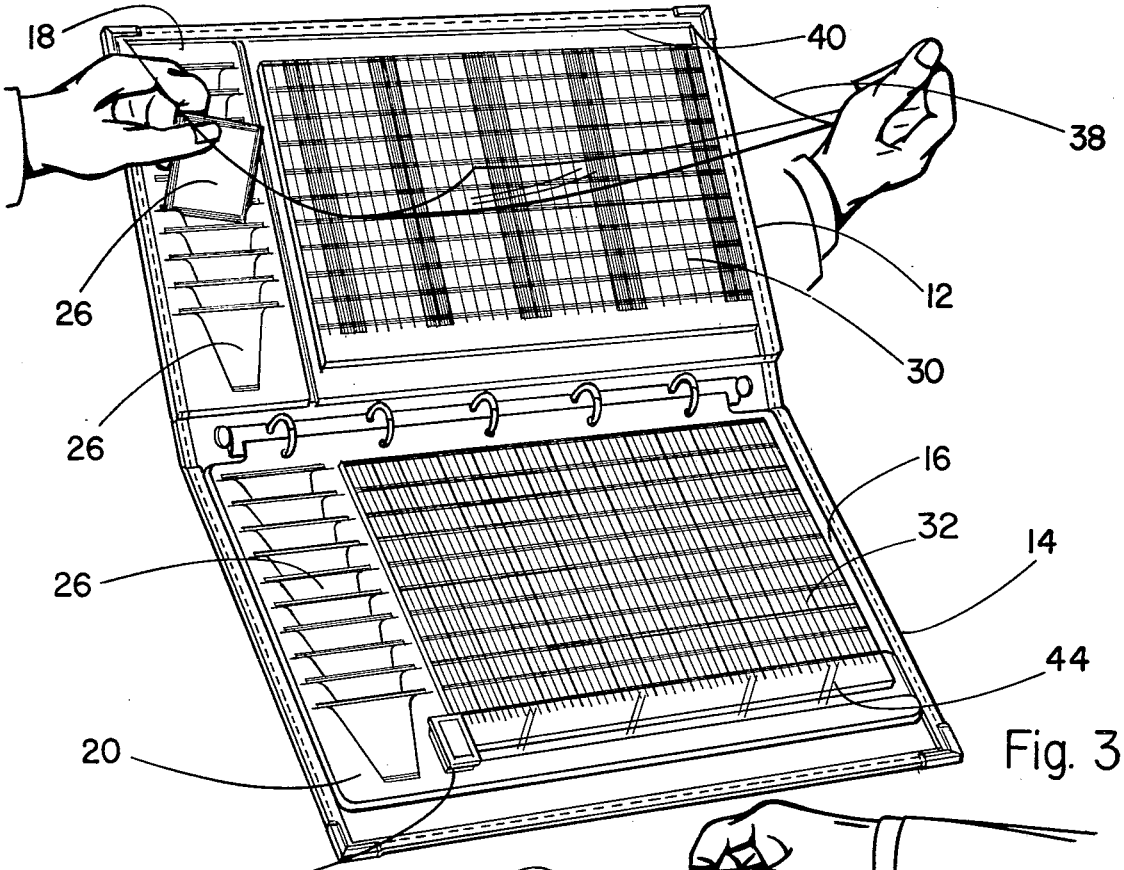
FIG. 3 is a view in perspective of the opened scheduling folder of FIG. 1 illustrating two of its panels.
Figure 4:
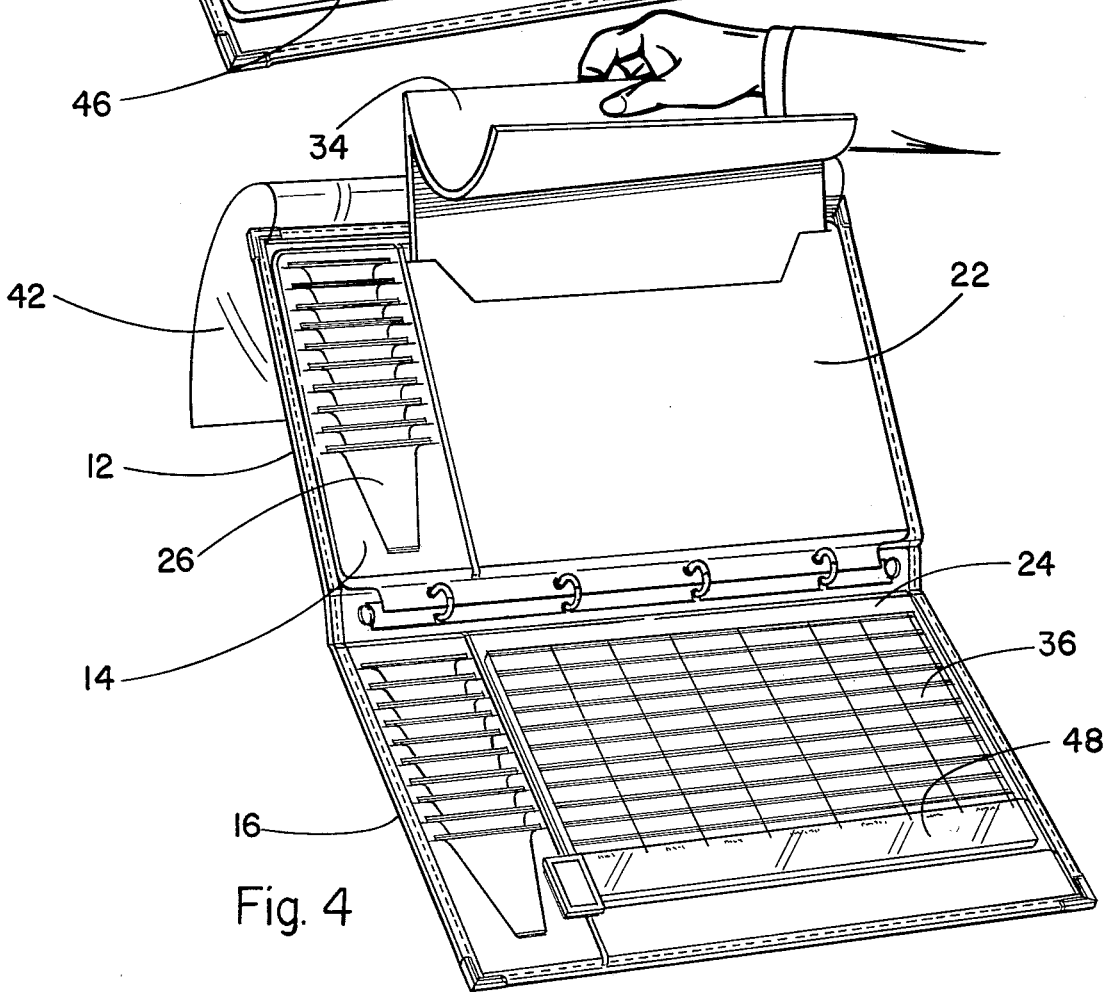
FIG. 4 is a view in perspective of the scheduling folder of FIG. 1 illustrating two other panels.

FIG. 3 illustrates the interior panel surface 18 of the front panel 12 and the forward facing surface 20 of the intermediate panel 16. Similarly, FIG. 4 illustrates the rearward facing surface 22 of the intermediate panel 16 and the forward facing surface 24 of the rear panel 14.

Each of these panel surfaces is formed with a plurality of card receiving pockets arranged in a column and spaced and aligned to position project cards 26 in overlapping arrangement to expose a portion of each card. As will be seen below, the exposed portion of each card has a height equal to the spacing of the pockets. The project cards 26 have selected identical dimensions so that they are interchangeable about the pockets and the standard card can fit in any of the pockets. Preferably, the columns of project cards are arranged vertically with respect to the observer although it will be seen that the principles of the present invention can be applied to a horizontally arranged row of project cards by appropriate modification or reorientation of the calendar.

A scheduling calendar is mounted to each panel surface beside each column of pockets. FIGS. 3 and 4 illustrate a calendar 30 illustrating a month, a calendar 32 illustrating a full year, a calendar 34 illustrating a day and a calendar 36 illustrating a week. The arrangement of the calendar and its interrelationship to the cards is important to the invention and is described in detail in connection with FIGS. 6 and 7.

A transparent flexible cover sheet 38 is attached along its upper edge 40 to the panel surface 18. It extends over and covers the cards 26 and the pockets located in the panel surface 18 and the calendar 30. The cover sheet 38 is constructed of vinyl or similar synthetic resin material preferably.

The flexible, transparent cover sheet 38 serves to prevent the entanglement of cards or other structure protruding from the interfacing panel surface 20 when the scheduling folder is closed. Therefore, it is only necessary to provide such a flexible cover on one of each pair of interfacing panel surfaces. The transparent cover sheet also holds the calendar pages in place when the panels are turned during a review. A similar flexible cover sheet 42 is also provided on the rearward panel surface 22 of the intermediate panel 14.

Panel surface 18 is essentially identical to panel surface 22 except for the calendars which are described below. All panels have the same column of project cards 26.

Panel surface 20, which has a calendar 32 is provided with a flexible, transparent strap which extends over the lower edge of the calendar 32 and is attached at its ends to the associated panel 16. One end, such as the end 46, is releasably attached to the panel surface 20 by a conventional, releasable fastener such as Velco, snaps or the like. It serves to maintain the calendar 32 firmly against the panel surface 20 and yet may be lifted to permit the addition of information to the calendar beneath the strap 44, or the removal of the calendar.

Similarly, the rear panel 16 is provided with a flexible, transparent strap 48 for the same purpose.

Figure 5:
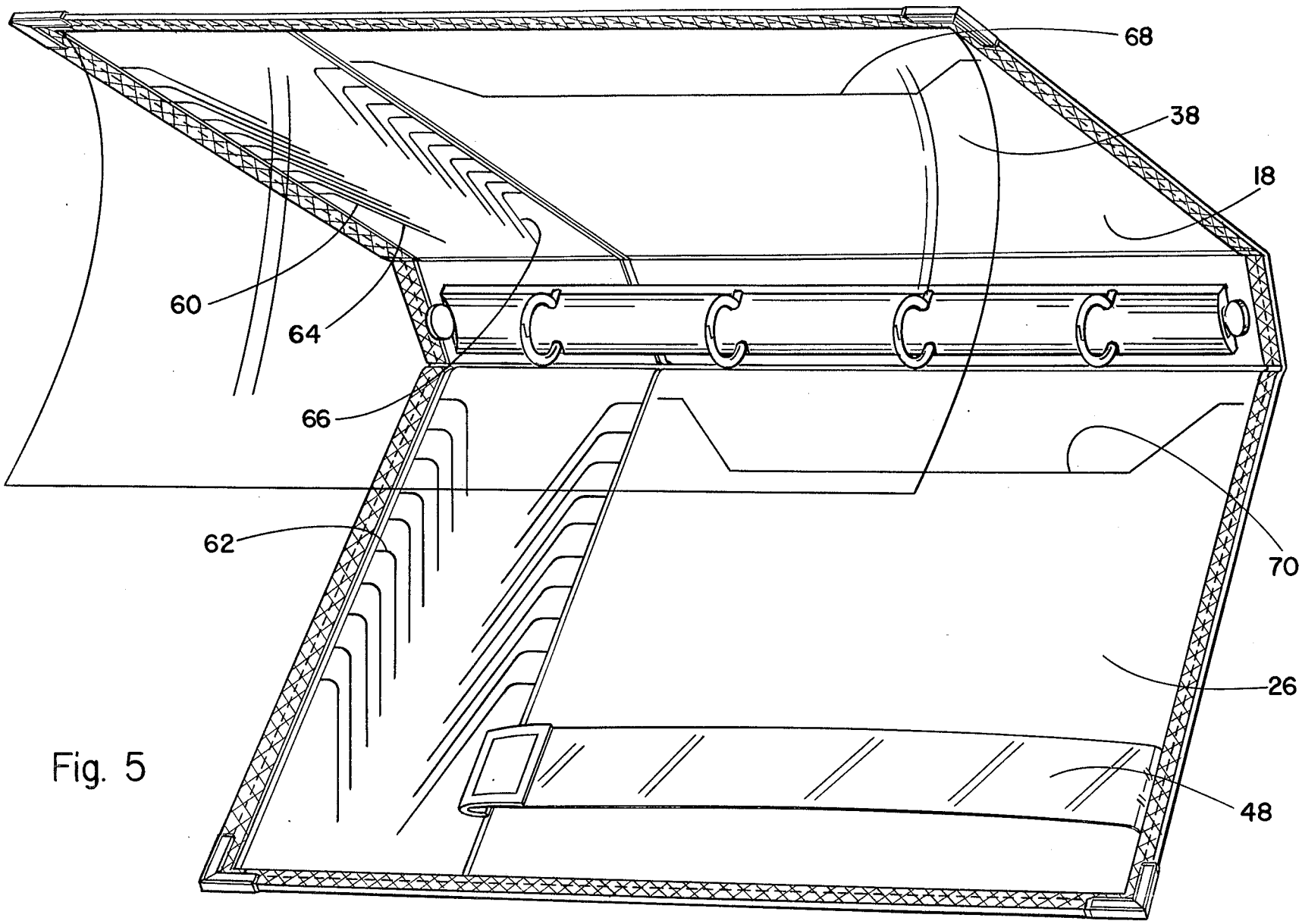
FIG. 5 is an enlarged view in detail illustrating the construction of the folder of FIG. 1 with the calendar and project cards omitted to reveal the underlying structure.

FIG. 5 illustrates in more detail the panel surfaces and other structures described above with the intermediate panel 16 removed to reveal the underlying structure. The pockets referring to above are formed in the manner described in my copending application, Ser. No. 258,671 filed Apr. 29, 1981 and entitled Memo Card Organizer. The panel surfaces 18 and 26 are formed by a sheet of flexible, synthetic resin. Each pocket of the columns of pockets 60 and 62 is formed by a pair of opposing, converging, spaced slits such as slits 64 and 66 which define the bottom pocket of pockets 60 formed in panel surface 18.

A relatively large slit 68 is also formed in the flexible, resin sheet forming panel surface 18 to receive the backing layer of a pad of calendars in the manner shown in FIG. 4. Similarly, a slit 70 is formed laterally of the pockets 62 for the same purpose.

Figure 6:
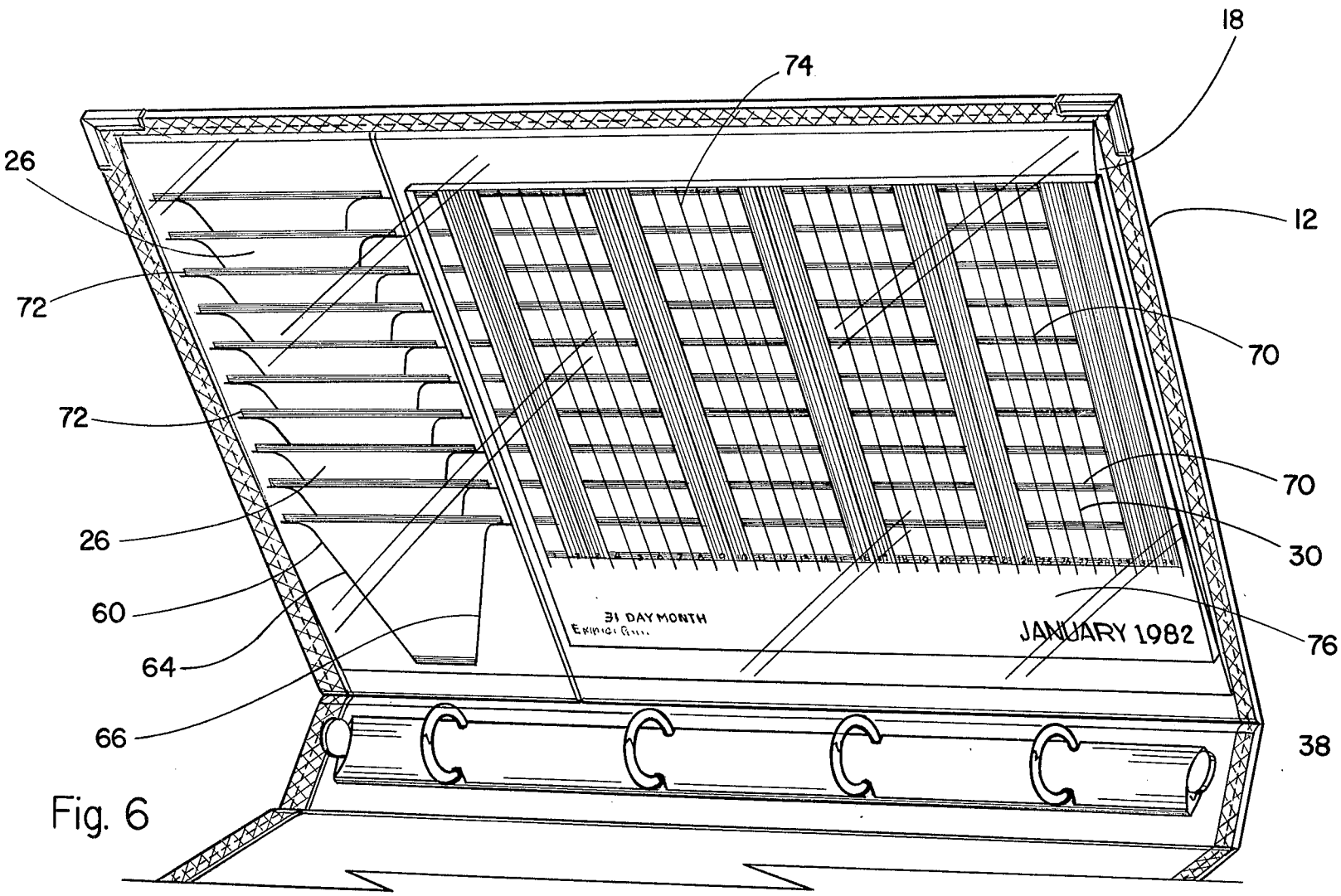
FIG. 6 is a view in detail illustrating a monthly calendar associated with a column of project cards embodying the present invention.

FIG. 6 illustrates in detail the one month calendar 30 mounted to the surface 18 of the front panel 12. Preferably each calendar, like the calendar 30, comprises a pad of calendars representing sequential time periods, such as the sequential months of the year, and a backing layer, such as a cardboard layer, all adhered together along one edge. In this manner the backing layer may be inserted in the large lateral slit 68, illustrated in FIG. 5, to firmly retain the calendar in position on the panel surface 18.

The most important characteristic of the calendar is that it has a plurality of parallel lines 70 which extend laterally of the column of pockets on the panel surface 18 and these lines are substantially aligned with the exposed edges 72 of the project cards 26.

The calendar also has a plurality of spaced lines 74 which are substantially parallel to the longitudinal axis of the column of pockets which form columns of spaces intersected by the lateral lines 70. Each of the columns of spaces is labelled with a sequential time/calendar interval such as the numerically indicated days of the month 76 indicated along the bottom of the columns of spaces.

Between each pair of lateral lines 70 is a row of spaces each corresponding to a labelled day of the month to provide a linear calendar. Each of these linear calendars is directly associated with the exposed portion of a project card 26. This permits each project to be individually scheduled with notations on its own calendar and permits each project card to be associated with its own calendar so that the executive may withdraw a card to have access to more detailed data when desired and additionally may see the interrelationship of the various projects for the month.

Figure 7:
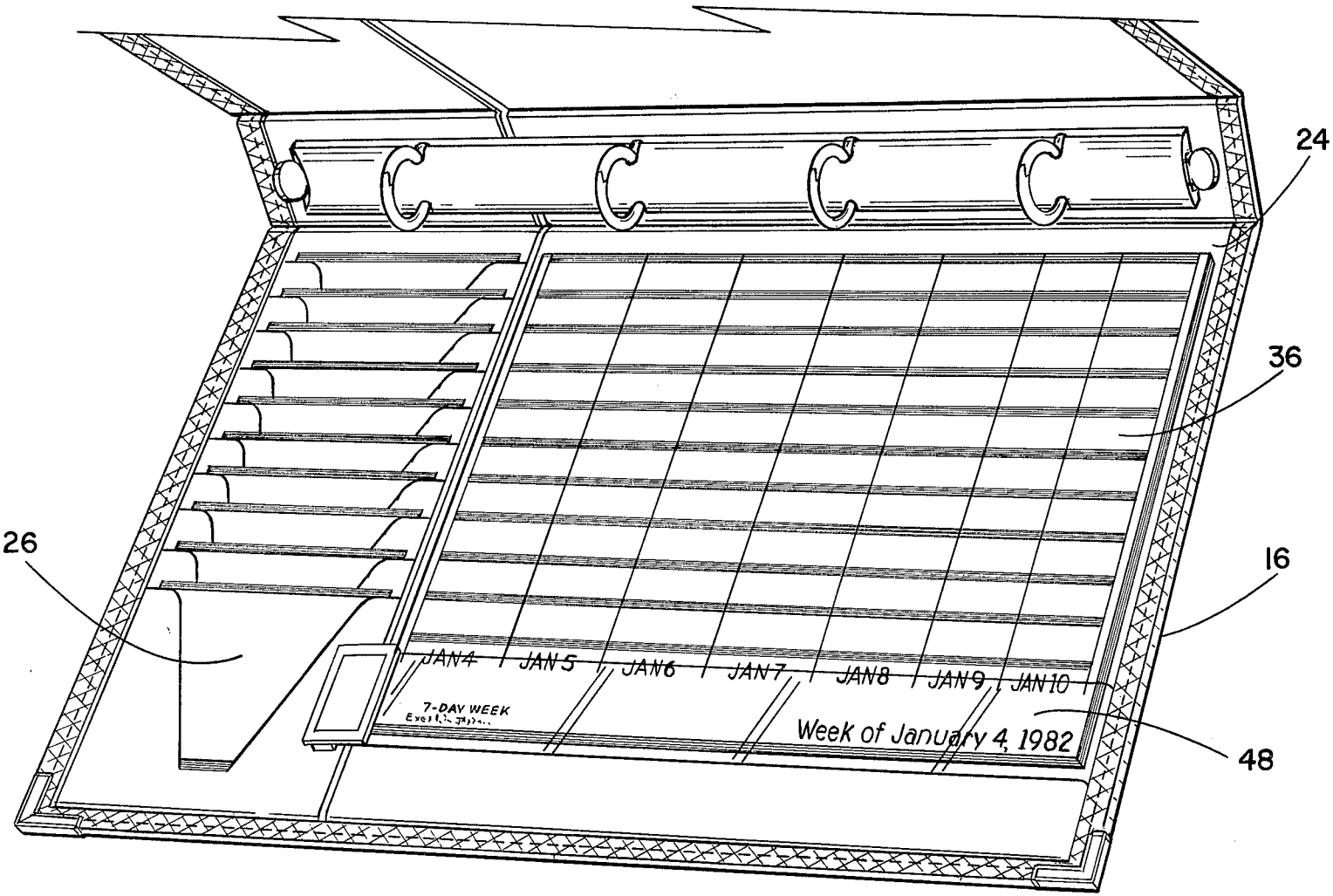
FIG. 7 illustrates the association of a weekly calendar with a column of project cards along with a flexible locking strap.

FIG. 7 illustrates the calendar 36 and cards 26 on the interior panel surface 24 of the rear panel 16. The calendar 36 is also constructed with a plurality of laterally extending parallel lines which are substantially aligned with the exposed edges of each of the project cards 26 to form the linear calendars. The columns of spaces formed by lines parallel to the longitudinal axis of the column of cards 26 are labelled with the days of the week.

Additionally, as illustrated in less detail in FIGS. 3 and 4, the vertical columns parallel to the longitudinal axis of the column of project cards may also be labelled with the hours of the day or the lines may be closely spaced and labelled with the days of a year. Since all of these labels represent the conventional manner of representing the passage of time based upon the rotation of the earth and the travel of the earth about the sun, time is referred to as time/calendar intervals since hours and days are celestially derived and are thus equivalent for purposes of this invention.

The operation and use of the scheduling folder embodying the present invention begins with the insertion of the project cards into the pockets formed by the converging slits. The cards may be differently colored in order to permit color coding of the projects by department, subject matter or urgency, for example. The calendars are also mounted to the panels by inserting their backing layer through the large lateral slit to position the calendar as illustrated in the drawing. The user may, depending upon his personal requirements, utilize one of each of the different calendars or multiple ones of particular calendars.

Preferably the upper exposed portion of each card held in a pocket is labelled with a title or short descriptive phrase for each project or subproject. The steps and details with respect to the projects, the individuals involved and so forth, are filled in below the title where they can easily be viewed by withdrawing the appropriate project card from its pocket.

Then the linear calendar adjacent the exposed portion of each project card may be filled in, such as with a line, to indicate the time interval during which the project is to be accomplished. Additionally, small notes with respect to the project may also be written in the linear calendar for each project as desired.

The scheduling folder may then be used by periodically scanning the various calendars and associated exposed card portions. Information with respect to the active projects may be obtained by glancing at the project cards at the side of the calendar for projects which need further attention.

If additional information is needed or if a thought should be recorded for later action the project card is withdrawn from the pocket as shown in FIG. 3. The review also permits an advance view of future scheduling needs and projects. Such a review may be done periodically during a day, daily, weekly or monthly. Perhaps for some executives a portion of the scheduling folder is viewed each day while other portions are only viewed monthly or weekly. During the review required actions may be taken or listed for action immediately following the review.

During a review, the eye may initially begin at the present date along the bottom of the columns on the calendar. The eye can scan upwardly to see what items are actively in process during the time interval and what items need attention. Marks may be needed on the calendars calling certain projects to the executive's attention for a particular day.

The scheduling folder is easily carried by itself as illustrated in FIG. 1 or in a briefcase. It may be taken to business meetings or to on site conferences where it may be reviewed and referred to during a meeting and updated. Additionally, it permits the review process to occur during travel time.

When a project is completed its card is simply removed from the pocket and a new card inserted in its place. The scheduling calendar entries are then continued for the new project on the adjacent linear calendar.

It is to be understood that while the detailed drawings and specific examples given describe preferred embodiments of the invention, they are for the purposes of illustration only, that the apparatus of the invention is not limited to the precise details and conditions disclosed and that various changes may be made therein without departing from the spirit of the invention which is defined by the following claims.

I claim:

1. An improved management scheduling folder of the type having a front panel hingedly connected to a rear panel and having at least one intermediate panel hingedly connected intermediate the front and rear panels, wherein the improvement comprises the combination of:

(a) a plurality of project cards having selected, identical dimensions;

(b) a plurality of panel surfaces formed on said panels, each panel surface having a plurality of card-receiving pockets arranged in a column and spaced and aligned to position cards received in said pockets in overlapping arrangement to expose a portion of each received card, said exposed portion having a height equal to the spacing of said pockets; and (c) a scheduling calendar mounted to each panel surface beside each column of pockets, each calendar having a chart portion having a plurality of parallel lines each extending laterally of said column of pockets and substantially aligned with an exposed edge of a different card positioned in said pockets such that information transcribed in each of said laterally extended lines of said calendar relates to the data of a single exposed project card which has said exposed edge aligned with that laterally extended line, each calendar also having a plurality of spaced lines substantially parallel to the longitudinal axis of said column of pockets to form columns of spaces intersected by said lateral lines, said columns of spaces being labelled with sequential time/calendar intervals.

2. A scheduling folder in accordance with claim 1 wherein a transparent flexible cover sheet is attached along one of its edges to at least one of said panels and extends over and covers said card pockets and said calendar.

3. A scheduling folder in accordance with claim 1 wherein said flexible cover sheet is attached to one of each pair of interfacing panel surfaces.

4. A scheduling folder in accordance with claim 1 wherein each calendar comprises a pad of calendars adhered together along one edge and mounted to the panel and wherein a flexible, transparent strap extends over the opposite edge of said pad and is attached at its ends to said panel, one of said ends being releasably attached.

5. An improved management scheduling folder of the type having a front panel hingedly connected to a rear panel and having at least one intermediate panel hingedly connected intermediate the front and rear panels wherein the improvement comprises the combination of:

(a) a plurality of project cards having selected identical dimensions;

(b) a plurality of panel surfaces formed on said panels, each panel surface having a plurality of card receiving pockets arranged in a column and spaced and aligned to position cards received in said pockets in overlapping arrangement to expose a portion of each received card, said exposed portion having a height equal to the spacing of said pockets wherein the panel surfaces are formed by a sheet of flexible synthetic resin, wherein each of said pockets is formed by a pair of opposing, converging spaced slits;

(c) a scheduling calendar mounted to each panel surface beside each column of pockets, each calendar having a plurality of parallel lines, each extending laterally of said column of pockets and substantially aligned with an exposed edge of a different card positioned in said pockets, each calendar also having a plurality of spaced lines substantially parallel to the longitudinal axis of said column of said pockets to form columns of spaces intersected by said lateral lines, said columns of spaces being labelled with sequential time/calendar intervals wherein each calendar comprises a pad of calendars and a rigid backing layer adhered together along one edge and mounted to the panel;

(d) a flexible transparent strap extends over the opposite edge of some of said pads and is attached at its ends to the associated panel, one of said ends being releasably attached;

(e) a slit is formed laterally of said column of pockets to receive said backing layer and retain said pad on said panel; and (f) a transparent flexible cover sheet is attached along one of its edges to at least one of each pair of interfacing panel surfaces and extends over and covers its card pockets and calendar.

6. A scheduling panel comprising:

(a) a plurality of project cards having selected, identical dimensions;

(b) a plurality of card-receiving pockets arranged in a column and spaced and aligned to position received cards in overlapping arrangement to expose a portion of each received card, said exposed portion having a height equal to the spacing of said pockets;

(c) a calendar mounted to said panel having a chart portion beside the column of pockets, the chart portion having a plurality of parallel lines each extending laterally of said column of pockets and substantially aligned with an exposed edge of a different card positioned in said pockets, each chart portion also having a plurality of spaced lines substantially parallel to the longitudinal axis of said column of pockets to form columns of spaces intersected by said lateral lines such that information transcribed in each of said laterally extended lines of said calendar relates to the data of a single project card which has an exposed edge aligned with that laterally extended line, each of said columns of spaces being labelled with sequential time/calendar intervals.

* * * * *